United States Patent [19]

Atkey

[11] Patent Number: 4,566,561

[45] Date of Patent: Jan. 28, 1986

[54] SELECTOR CABLING ARRANGEMENT

[75] Inventor: Richard E. Atkey, Memphis, Tenn.

[73] Assignee: Dover Corporation, New York, N.Y.

[21] Appl. No.: 594,232

[22] Filed: Mar. 28, 1984

[51] Int. Cl.[4] ..... B66B 11/04

[52] U.S. Cl. ..... 187/20; 187/27; 254/336; 254/285

[58] Field of Search ..... 187/20, 22, 27; 254/415, 284, 285, 336, 335; 182/141

[56] References Cited

U.S. PATENT DOCUMENTS

| | | | |
|---|---|---|---|
| 200,624 | 2/1878 | Miller | 187/20 |
| 2,808,126 | 10/1957 | Harrer | 187/20 |
| 3,912,230 | 10/1975 | Learmont | 254/336 |

FOREIGN PATENT DOCUMENTS

| | | | |
|---|---|---|---|
| 249899 | 8/1926 | Italy | 254/336 |

*Primary Examiner*—Joseph J. Rolla
*Assistant Examiner*—Kenneth Noland
*Attorney, Agent, or Firm*—Brumbaugh, Graves, Donohue & Raymond

[57] ABSTRACT

An elevator system has a selector mechanism driven by a cable loop attached to the elevator car. The opposite cable ends are wound on a take-up drum, in opposite rotational directions, in sequential rows across the drum, such that the cable leads travel back and forth across the drum as the drum rotates. A selector cable guide includes a frame pivotable about an axis generally perpendicular to the drum axis. The frame is disposed about the drum, and has a pair of pulleys mounted adjacent to the pivot axis, and a second pair of pulleys mounted to the frame on the opposite side of the drum. Each cable portion is guided about one of the first pulleys, thereafter about one of the second pulleys, and is thereafter wrapped onto the drum. The second pulleys swing laterally to follow the position of the cable leads as they travel across the drum, whereas the first pulleys remain relatively stationary for directing the cable portions up and down the elevator shaft from a relatively constant position.

11 Claims, 2 Drawing Figures

SELECTOR CABLING ARRANGEMENT

BACKGROUND OF THE INVENTION

The present invention is an improved cable guide for the selector mechanism of an elevator system.

With elevators used for vertical transportation, it is common to reproduce the position and motion of the car remotely and on a smaller scale with a device driven by the car. This device is known in the industry as a selector. The simulated car position in the selector is used as an input of various control systems for the elevator drive system.

A typical drive for an elevator selector mechanism is a cable loop which is disposed in the hoistway parallel to the direction of movement of the elevator car. Portions of the cable extend in opposite directions from the car, up and down in the shaft, respectively, and are deflected from the top and bottom of the shaft to a common input drive of the selector. The cable is attached to the elevator car so that motion of the car moves the cable and thereby the selector input.

Since no slippage can be tolerated, the cable must be attached relative to the selector input. Typically, the cable is attached to a storage take-up drum of sufficient size to allow the full travel of the car. The two cable portions, arriving from the top and bottom of the elevator shaft, are connected to the drum to wind in opposite rotational directions of the drum. Rotation of the drum thereby causes one cable portion to wind and causes the other cable portion synchronously to unwind. The cable portions are attached to opposite ends of the drum and wound in sequential rows, across the drum, toward one another.

As the cable feeds on and off the storage drum, the leads, of necessity, travel from side to side across the surface of the drum. This lateral motion complicates running the cable to and from the car, particularly in cramped areas, a problem which has plagued the industry for many years.

In an effort to alleviate the problems inherent in feeding cable from a drum, some companies have abandoned the use of cables in favor of chain or tape drives. However, such drives are less flexible, more expensive, and susceptible to breakage. Other devices such as floating idler sheaves are in common use, but at best such devices only reduce the difficulties and are themselves a problem to maintain.

SUMMARY OF THE INVENTION

The present invention is an improved cable guide for a cable-driven selector mechanism which solves the longstanding industry problem of lateral cable motion.

More particularly, the invention is a selector cable guide for an elevator system having a selector mechanism driven by a cable connected to the car and wound on a take-up drum in sequential rows across the drum. The selector cable guide includes a frame pivotable about an axis generally perpendicular to the rotational axis of the take-up drum. The frame has a portion extending toward the drum, and has a first pulley mounted adjacent to the pivot axis and a second pulley mounted on the portion extending towards the drum. The cable is guided about the first pulley, about the second pulley, and thereafter onto the drum. The position of the second pulley adjusts to the lead position of the cable as it travels across the drum, whereas the position of the first pulley remains relatively stationary regardless of the position of the second pulley. Accordingly, the second pulley remains in registry with the lead of the cable on the drum, but the lateral position of the cable leaving the first pulley, which extends up or down the elevator shaft and thereafter to the car, remains stationary.

Preferably, the cable has portions extending in opposite directions from the car. The oppositely extending cable portions are directed up and down the elevator shaft, respectively, over pulleys at the top and bottom of the shaft, and thereafter in the reverse direction to meet at the selector cable guide. The cable guide includes a pair of first pulleys mounted on the frame adjacent to the pivot axis, and a pair of second pulleys mounted to the frame on the portion extending toward the drum. Each cable portion is guided about one of the first pulleys and thereafter about one of the second pulleys, and is thereafter connected to the drum. The cable ends wind in opposite rotational directions of the drum so that, when the elevator car moves, one of the cable portions unwinds from the drum, and simultaneously the other cable portion winds onto the drum in sequential rows across the drum.

Preferably, the frame is disposed about the drum, and the pulleys adjacent the pivot axis and the pulleys on the extending portion of the frame lie on opposite sides of the drum in approximately 90° quadrants. Preferably also, the first pulleys are mounted on the frame to have a tangent which lies approximately along the pivot axis, so that cable portions from the car engage the first pulleys in a line approximately parallel, and closely spaced to, the pivot axis.

For a better understanding of the invention, reference is made to the following detailed description of a preferred embodiment, taken in conjunction with the drawings accompanying the application.

DETAILED DESCRIPTION OF A PREFERRED EMBODIMENT

An elevator system includes a car which is vertically displaceable in a hoistway (not shown). Movements of the elevator car up and down in the hoistway are simulated, on a smaller scale, in a selector mechanism 10 which may be of any conventional design. The selector mechanism 10 is driven by a take-up drum 12, which in turn is connected to the elevator car by a cable loop, having cable portions 14 and 16, in the manner described below.

Figure 2:
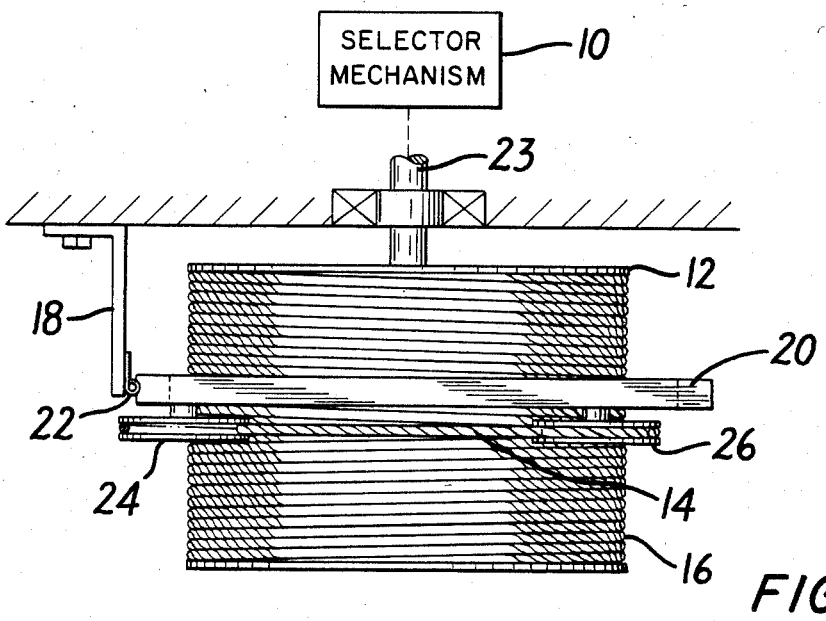
FIG. 2 is a top schematic view of the mechanism shown in FIG. 1, coupled to a selector mechanism.

A selector cable guide includes a fixed support bracket 18 and a frame 20 pivotably mounted by a hinge, about pivot axis 22, on the support bracket 18. The hinge axis 22 is perpendicular to the rotational axis 23 of the take-up drum 12. As shown, the frame 20 is disposed about the drum 12. Four pulleys 24, 26, 28 and 30 are rotatably mounted to the frame outside the circumference of the drum 12 in approximately 90° quadrants, with the hinge axis 22 lying approximately along a tangent to pulleys 24 and 28. Accordingly, when the frame pivots, the tangent along which the cable extends (up and down the shaft) remains relatively stationary. As shown, the hinge axis 22 is offset slightly from the center of the drum so that the pulleys 24, 26, 28 and 30 lie approximately in the central plane of the drum 12 when the frame 20 is in the middle position (shown in FIG. 2).

In one cable arrangement, the cable portion 14 is attached to one end of the drum, wraps counterclockwise around the drum, toward the middle of the drum, sufficient to provide adequate storage, thereafter loops over pulley 26, under pulley 24, and extends away from pulley 24 along a line parallel to, and closely spaced to, the hinge axis 22 to the top of the elevator shaft. There, the cable is deflected down to the elevator car, where it is attached, and extends (now as cable portion 16) down to the bottom of the shaft, where it is deflected back up along the hinge axis 22. Cable portion 16 thereafter extends up over pulley 28, under pulley 30, and to the drum 12. The lead 16*a* of cable portion 16 engages the drum 12 at a position adjacent to the lead 14*a* of cable portion 14 leaving the drum. From there, it is wrapped clockwise about the drum toward the end of the drum opposite of cable portion 14, where the end of cable portion 16 is attached to the drum. Cable portions 14 and 16 are thereby connected to opposite ends of the drum, each cable portion being wrapped in sequential rows toward the center of the drum to the point where they meet.

Figure 1:
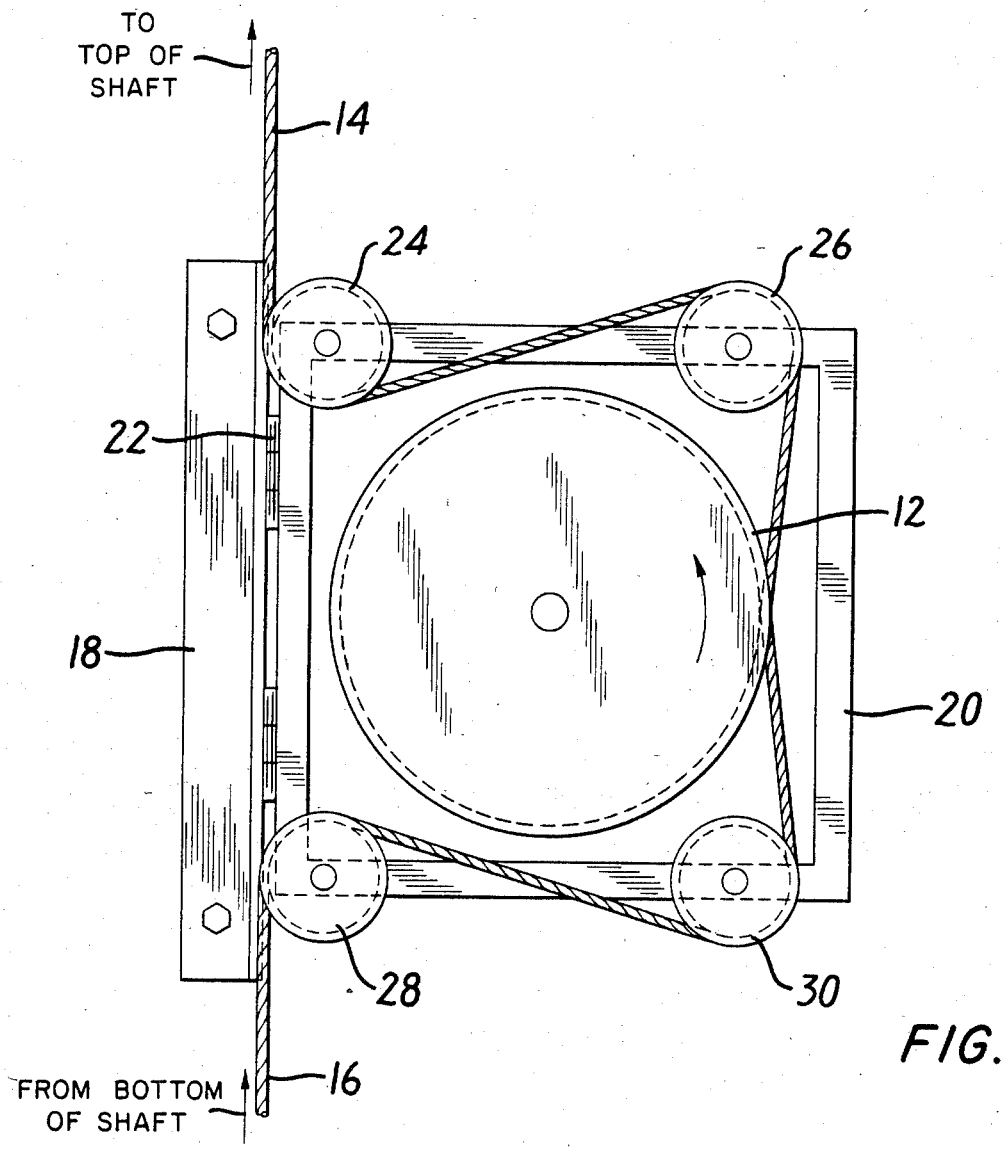
FIG. 1 is a side schematic view of a selector mechanism drive in accordance with the invention.

In operation, a downward motion of the car will rotate the drum counterclockwise (in the arrangement shown in FIG. 1), whereas an upward motion of the elevator car will rotate the drum clockwise. Rotation causes one cable portion to wind and the other simultaneously to unwind. The leads 14*a* and 16*a* synchronously travel laterally across the drum in a direction dependent upon the direction of rotation.

Since the frame and pulleys 26 and 30 are free to swing about the hinge axis 22, the portions of the cable leading from the drum 12 to pulleys 26 and 30, i.e. leads 14*a*, 16*a*, will force the outer edge of the frame 20 to follow their movement across the drum. However, since the cable from pulleys 24 and 28 leaves the pulleys substantially along the hinge axis 22, little lateral motion occurs. It should be noted that, in addition to solving the problem of lateral cable travel, the invention further improves existing arrangements by removing most of the force produced by cable tension from the storage drum.

The foregoing represents a description of a preferred embodiment of the invention. Variations and modifications of this embodiment will be apparent to persons skilled in the art, without departing from the inventive concepts disclosed herein. For example, alternate cable arrangements are possible. The cable portion 14, instead of being wrapped under cable 24, may be looped over cable 24, and leave in a downward direction instead of upward (cable portion 16 similarly being wrapped to extend in the opposite direction). Cable portions 14 and 16 are described as being a single, continuous cable. However, two or more cables may be used. In addition, rather than having a pair of oppositely acting cable portions 14, 16 (extending in different directions from the elevator car), and being received to wind in opposite directions on the drum, it may also be possible to employ a single cable portion, e.g. 14, extending from the drum to the car, with a biasing mechanism operating on the drum to wind it in the take-up direction (which force is otherwise applied by the oppositely acting cable portion 16). All such modifications and variations are intended to be within the scope of the present invention, as defined in the following claims.

I claim:

1. In an elevator system having a selector mechanism, for simulating the position and movements of the elevator car, and means for actuating the selector mechanism including cable means connected to the car and a take-up drum for winding or unwinding the cable means in sequential rows across the drum, wherein the drum is rotatable about a rotational axis and the lead of the cable means travels across the drum in the axial direction as the drum is rotated; a selector cable guide comprising:

a frame pivotable about a pivot axis generally perpendicular to the rotational axis, the frame having a portion extending from the pivot axis;

a first pulley means mounted to the frame adjacent to the pivot axis; and a second pulley means mounted to the frame on the extending portion; wherein the cable means is guided about the first pulley means, the second pulley means, and then onto the drum; wherein the position of the second pulley means adjusts to the lead position of the cable as it travels across the drum, wherein the position of the first pulley means remains substantially stationary, in the direction of the rotational axis, regardless of the position of the second pulley means, and wherein further the cable means comprises a cable having portions extending in opposite directions from the car, the oppositely extending cable portions being connected to the drum to wind in opposite rotational directions of the drum, each being arranged to wind and unwind in sequential rows across the drum, wherein the first pulley means comprises a pair of first pulleys mounted to the frame adjacent the pivot axis, and wherein the second pulley means comprises a pair of second pulleys mounted to the frame on the extending portion, wherein each cable portion is guided about one of the first pulleys and one of the second pulleys and thereafter onto the drum.

2. An elevator system as defined in claim 1, wherein the frame is disposed about the drum and the first pulleys lie on opposite sides of the drum from the second pulleys.

3. An elevator system as defined in claim 2, wherein the pulleys lie in approximately 90° quadrants.

4. An elevator system as defined in claim 3, wherein the pivot axis lies approximately along a tangent of the first pulleys.

5. An elevator system as defined in claim 4, wherein the pivot axis is substantially parallel to the direction of movement of the elevator car.

6. An elevator system as defined in claim 1, wherein the first pulley means and the second pulley means are mounted on the frame such that the cable means engages the first pulley means along a tangent generally parallel to the pivot axis, and extends from the first to the second pulley means in a direction generally perpendicular to the pivot axis.

7. An elevator system as defined in claim 1, wherein the first pulley and second pulleys are mounted on the frame such that each cable portion engages its respective first pulley along a tangent generally parallel to the pivot axis, and extends from the first to its respective second pulley in a direction generally perpendicular to the pivot axis.

8. An elevator system as defined in claim 7, wherein the first pulleys lie on opposite sides of the drum from the second pulleys.

9. An elevator system as defined in claim 8, wherein the pivot axis is substantially parallel to the direction of movement of the elevator car.

10. An elevator system as defined in claim 1, wherein the pulleys lie in approximately 90° quadrants.

11. An elevator system as defined in claim 10, wherein the pivot axis is substantially parallel to the direction of movement of the elevator car.

* * * * *